US006253948B1

(12) United States Patent
Ficker

(10) Patent No.: US 6,253,948 B1
(45) **Date of Patent: *Jul. 3, 2001**

(54) NESTABLE CONTAINER WITH EXPENDABLE CLOSURE PANEL COVERING ACCESS OPENING IN CONTAINER WALL

(75) Inventor: Paul J. Ficker, Cincinnati, OH (US)

(73) Assignee: Buckhorn, Inc., Milford, OH (US)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/239,535

(22) Filed: Jan. 29, 1999

(51) Int. Cl.[7] ..... B65D 43/14; B65D 43/04

(52) U.S. Cl. ..... 220/350; 220/4.01; 220/676

(58) Field of Search ..... 220/4.01, 4.28, 220/4.31, 345.1, 676, 345.2, 345.3, 345.4, 350, 351; 229/162; 206/738, 767, 736, 758, 769, 772, 774; 211/49.1

(56) References Cited

U.S. PATENT DOCUMENTS

| | | | | |
|---|---|---|---|---|
| Re. 7,371 | | 10/1876 | Maginn et al. . | |
| 183,175 | * | 10/1876 | Kelly et al. | 229/162 X |
| 989,094 | | 4/1911 | Wilson . | |
| 1,544,463 | * | 6/1925 | Lengsfield | 229/162 X |
| 2,054,785 | * | 9/1936 | Harris | 217/122 |
| 2,249,430 | * | 7/1941 | Lambert | 206/764 |
| 2,496,918 | * | 2/1950 | Promisel | 217/11 |
| 2,908,985 | | 10/1959 | Hartman . | |
| 2,941,691 | * | 6/1960 | Weinberg | 220/345.2 |
| 3,008,624 | * | 11/1961 | Royce | 229/199.1 |
| 3,132,431 | | 5/1964 | Petrie . | |
| 3,443,737 | | 5/1969 | Kupersmit . | |
| 3,656,611 | * | 4/1972 | Mertz | 206/764 |
| 3,997,055 | | 12/1976 | Box . | |
| 4,111,413 | * | 9/1978 | Marcus | 472/137 |
| 4,382,504 | * | 5/1983 | Vesborg | 206/766 |
| 4,416,374 | * | 11/1983 | Smith et al. | 206/507 |
| 4,765,077 | | 8/1988 | Rosenthal et al. . | |
| 4,779,366 | | 10/1988 | Jost . | |
| 4,865,187 | | 9/1989 | Zulauf et al. . | |
| 4,982,843 | * | 1/1991 | Jones | 220/350 X |
| 5,275,302 | * | 1/1994 | Uitz | 220/4.28 |
| 5,277,360 | | 1/1994 | DeMott . | |
| 5,285,900 | | 2/1994 | Swingler . | |
| 5,400,914 | * | 3/1995 | Lin | 220/351 X |
| 5,415,315 | * | 5/1995 | Ramirez | 220/345.2 |
| 5,662,223 | * | 9/1997 | Sylegard | 206/508 |

FOREIGN PATENT DOCUMENTS

| | | |
|---|---|---|
| 2069461 | 8/1981 | (GB) . |

* cited by examiner

*Primary Examiner*—Allan N. Shoap
*Assistant Examiner*—Joe Merek
(74) *Attorney, Agent, or Firm*—Mattingly, Stanger & Malur, P.C.

(57) ABSTRACT

A stackable nestable container has access openings in at least one of the side and end walls. The access openings are covered by a dispensable panel that can be removed for enabling access to the contents of the container. The container is therefore suitable for use in shipping goods as well as displaying the goods at a retail outlet. Upon return of empty containers, the panels do not need to be replaced and the containers can be stacked in a nested stack, separately from the lids. Then, when the containers are to be used again, new or replacement panels are fit into the access openings. The panels are of a lightweight, inexpensive material and are therefore expendable, and can even be discarded by the user when a need arises to remove or replace the panels. Also, the panels have a wide flat area on which advertising or other indicia can be printed, which is typically displayed on the sides of containers.

15 Claims, 8 Drawing Sheets

NESTABLE CONTAINER WITH EXPENDABLE CLOSURE PANEL COVERING ACCESS OPENING IN CONTAINER WALL

FIELD OF THE INVENTION

The invention relates to a stackable and nestable container having a lid, and in particular to a container with a replaceable, preferably expendable closure panel covering an access opening in one or more walls of the container.

DESCRIPTION OF THE RELATED ART

Stackable and nestable containers are well known, particularly reusable injection molded plastic containers. Containers such as these are used for shipping goods, for example from a manufacturer or supplier of goods at a distribution center to an end user, such as a distribution outlet, retail store, restaurant, grocer or the like. The goods may be emptied from the container for restocking the end user's supplies or for display on shelves in a retail outlet, or they may be displayed without being removed from the containers such as in a warehouse, stock room or retail outlet. Eventually the containers are emptied of the contents and the containers are returned to the manufacturer or supplier from where they originated. During return shipment, the containers are empty, so it has been well recognized that it is advantageous to reduce the cargo space or volume occupied by such empty containers by permitting nested stacking of the containers.

U.S. Pat. No. 3,997,055 to Box is representative of a container that is used for shipping goods to a retail distribution outlet and displaying the goods from the container for retail sale. In this example, the containers are milk carton transport cases and the display of the cartons of milk is accomplished by the removal one or more panels, such as an end panel that is releasably fastened to the case. The removable panel is formed of the same type of plastic molded structure as that of the remainder of the container. As a result, after removal of the panels, the panels must be stored separately from the transport cases when the cases are used for displaying the milk cartons in a retail setting.

In the use of containers such as that disclosed in U.S. Pat. No. 3,997,055, the need to maintain storage of the removable panels during use of the cases for retail display is disadvantageous in that most retail outlets do not have adequate space for storage of such panels. Accordingly, the panels can become misplaced, broken or otherwise forgotten when it comes time for return shipment of the cases. Further, upon emptying the cases that have been used for display, it is necessary to retrieve the panels from wherever they are stored and fit them back into place before the cases are shipped back to the dairy. Finally, the cases disclosed by Box are not suitable for nested stacking, so the return shipment of the containers occupies as much cargo space (volume) in a transport vehicle, such as a truck, as the original shipment of the cases, which is disadvantageous as well.

SUMMARY OF THE INVENTION

It is an object of the invention to overcome the problems associated with containers used for shipping goods, in which the containers have removable panels that cover access openings in the walls of the container for permitting display and picking of the goods from the container without opening the top of the container.

In particular, it is an object of the invention to overcome the problems with the prior art containers having removable panels in which the panels must be separately stored during use of the containers for display and then retrieved from storage and replaced or re-fit into the walls of the containers before return shipment thereof to the manufacturer. Associated with this problem in the prior art, is the need to replace any missing or broken panels with new ones, which becomes expensive and burdensome.

It is a further object of the invention to overcome the disadvantages of using containers intended for access of the goods contained therein by removal of a panel in a wall of the container by providing such a container that is capable of return shipment in a nested stack.

According to the present invention, these objects are achieved and the above-mentioned problems and disadvantages of the prior art are overcome by providing a container of unitary plastic molded construction having an open top with a separate lid wherein at least one of the side and/or end walls has an access opening coverable by a panel that when removed permits display of the goods in the container as well as removal of the goods from the container when the container is used for display. In particular, according to the invention, the panels that cover the access openings are intended to be expendable so that if the container is used for display at a retail outlet, for example, the panels can be removed and discarded thereby overcoming the need to reserve storage space for the panels and also thereby overcoming the need to replace the panels before return shipment of the containers. Further, use of the containers constructed according to the invention by manufacturers or suppliers is made advantageous by enabling nested stacking of the containers during return shipment thereof. Upon return of the containers to their origin, new expendable panels can be fit into the access openings for reuse of the containers.

It is another object of the invention to provide expendable panels for covering the access panels of the container that are constructed of a lightweight, inexpensive material, such as cardboard, that includes a display area for displaying commercial messages, advertising or indicia related to the contents of the goods. In this manner, the expendable panels can be printed with specific information related to the goods to be transported in the containers, and the types of panels can be readily changed depending on the goods shipped in the containers. This enable flexibility by allowing the display of indicia on the containers of the goods to be readily changed without the need for otherwise marking the container either temporarily or permanently. This has the further advantage that the containers constructed according to the invention can be manufactured for many different customers and uses, and the individual users can independently customize their use of the containers with use of the panels.

DETAILED DESCRIPTION OF A PREFERRED EMBODIMENT

Figure 1:
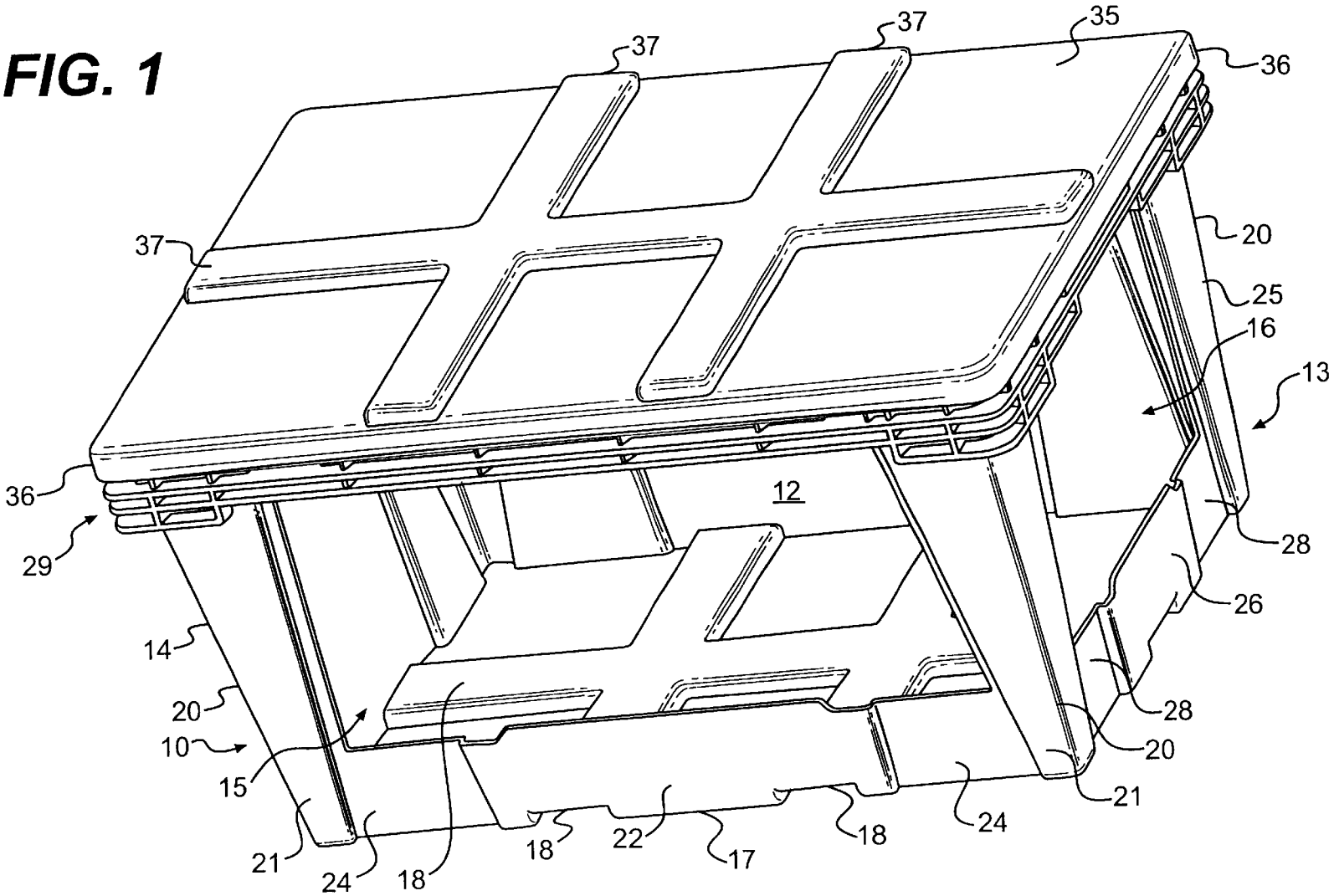
FIG. 1 is a perspective view of a container and lid combination having openings in a side and end wall thereof for accepting a replaceable closure panel according to the present invention.

A preferred embodiment of a container 10 constructed according to the present invention is shown in FIGS. 1–8. The container has opposed side walls 11 and 12, opposed end walls 13 and 14, a bottom wall 17 and an open top. An access opening 15 is provided in side wall 11 and an access opening 16 is provided in end wall 13. The side wall 12 and end wall 14 are shown without an access opening and are therefore of solid wall construction, but may optionally be provided with an access opening, according to the invention.

Preferably, the container is of a unitary plastic molded construction, molded according to well known injection molding techniques, for example. The container is stackable and includes a lid 35 on which is formed a stacking grid 37 that is intended to interfit with a stacking grid 18 formed in bottom wall 17 of the container (not shown in FIG. 2).

Figure 2:
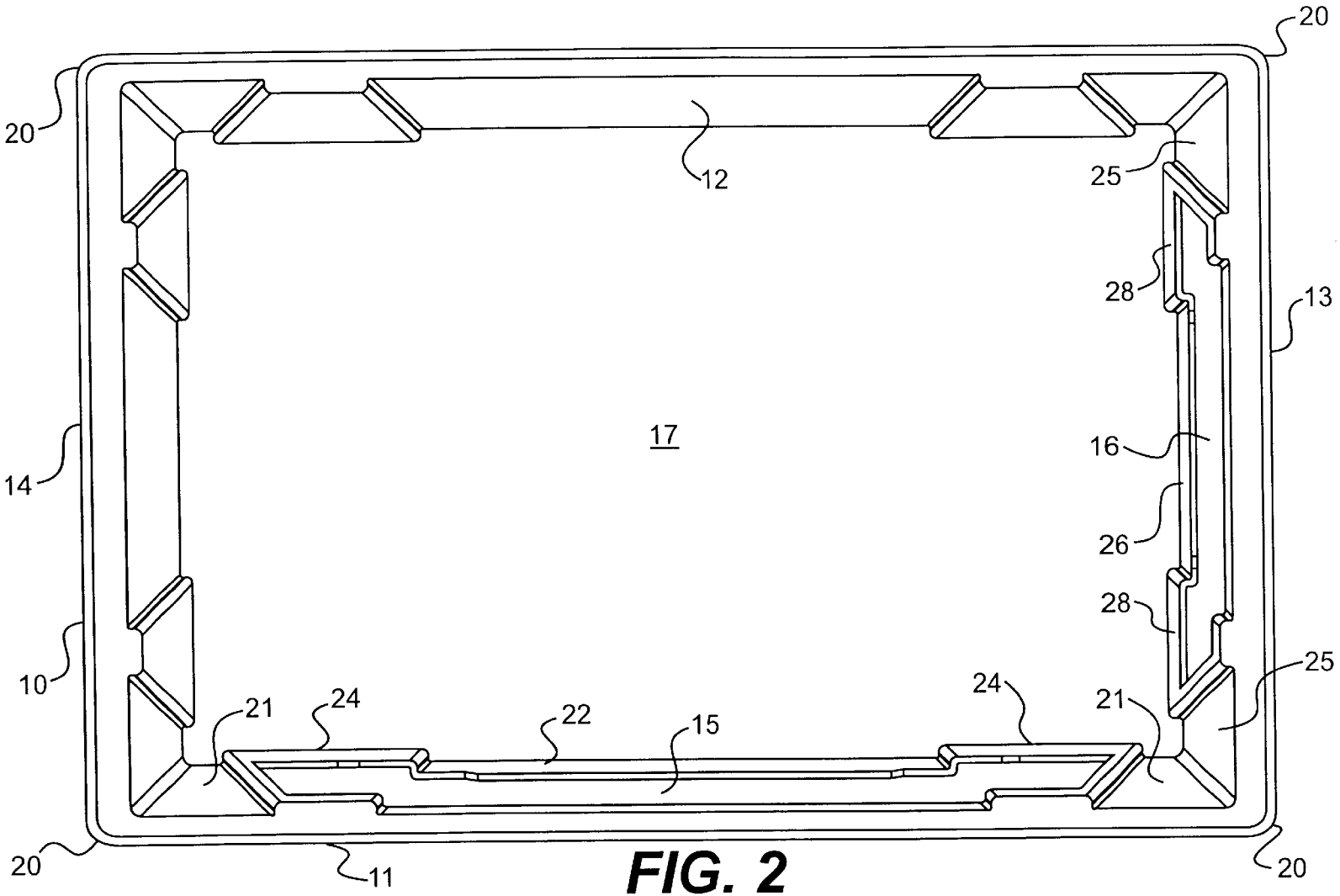
FIG. 2 is a top view of the container shown in FIG. 1 without the lid.

FIG. 2 shows the interior of the container with the detail of the inwardly sloping side walls 11, 12 and end walls 13, 14. Further, as shown in FIGS. 1 and 2, the container has corners 20 having side wall portions 21 and end wall portions 25. In side wall 11, a center portion 22 is provided that is in the same plane as the side wall portions 21 of the corners 20. Similarly, in the end wall 13, a center portion 26 is provided that is in the same plane as the end wall portions 25 of corners 20. Between the corners 20 and the center portion 22 of the side wall are recessed side wall portions 24 and similarly between the end wall portion 25 of the corners 20 and the center portion 26 of end wall 13 is a recessed end wall portion 28.

A peripheral flange structure 29 having a flange portion 30 is formed around the top of container 10. As shown in FIG. 1, lid 35 has a lid flange 36 that snaps over the flange 30 to close the open top of the container 10.

Figure 5:
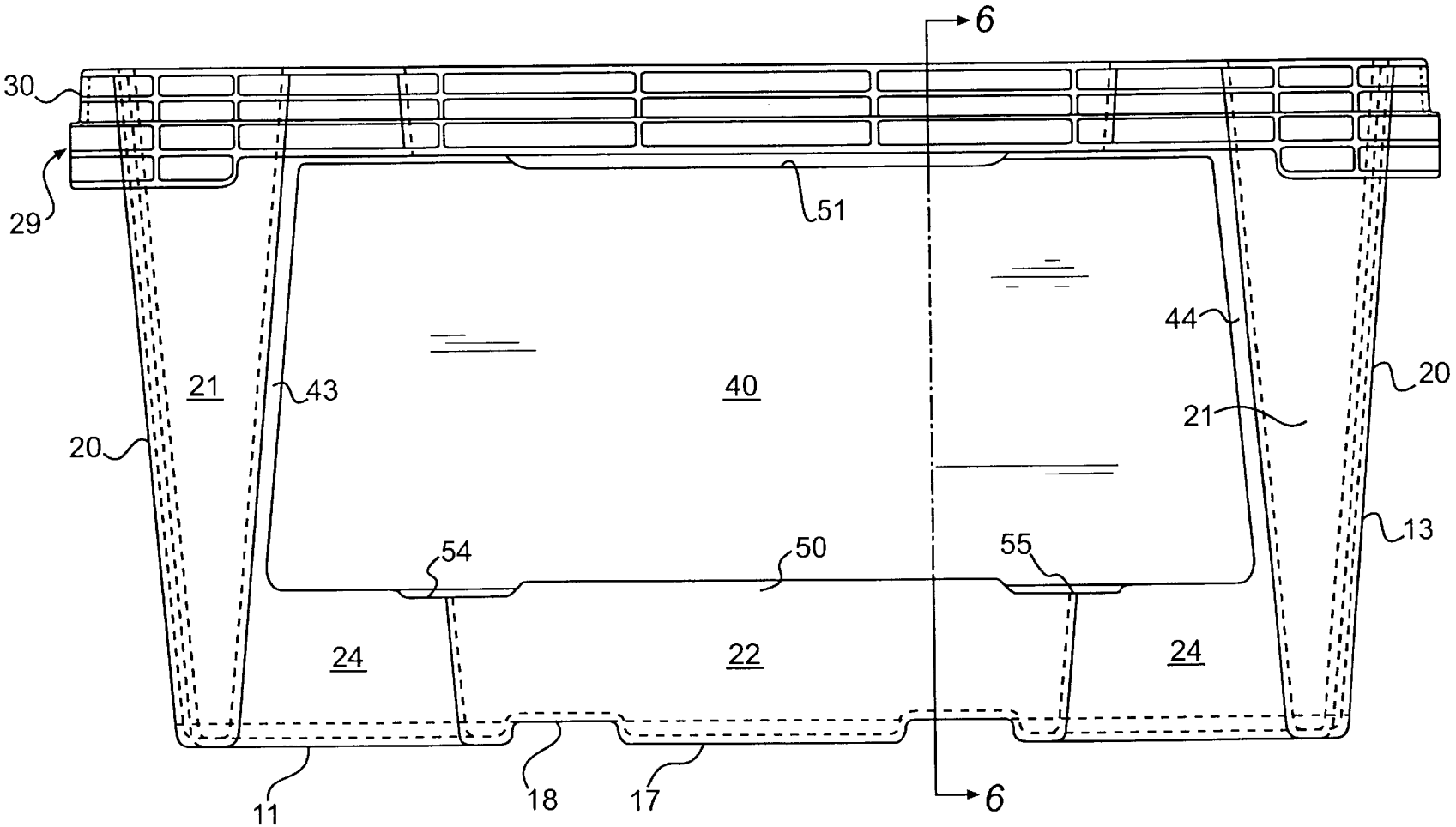
FIG. 5 is a side view of the container of the invention showing the replaceable closure panel fit in the access opening in the side wall of the container.
Figure 7:
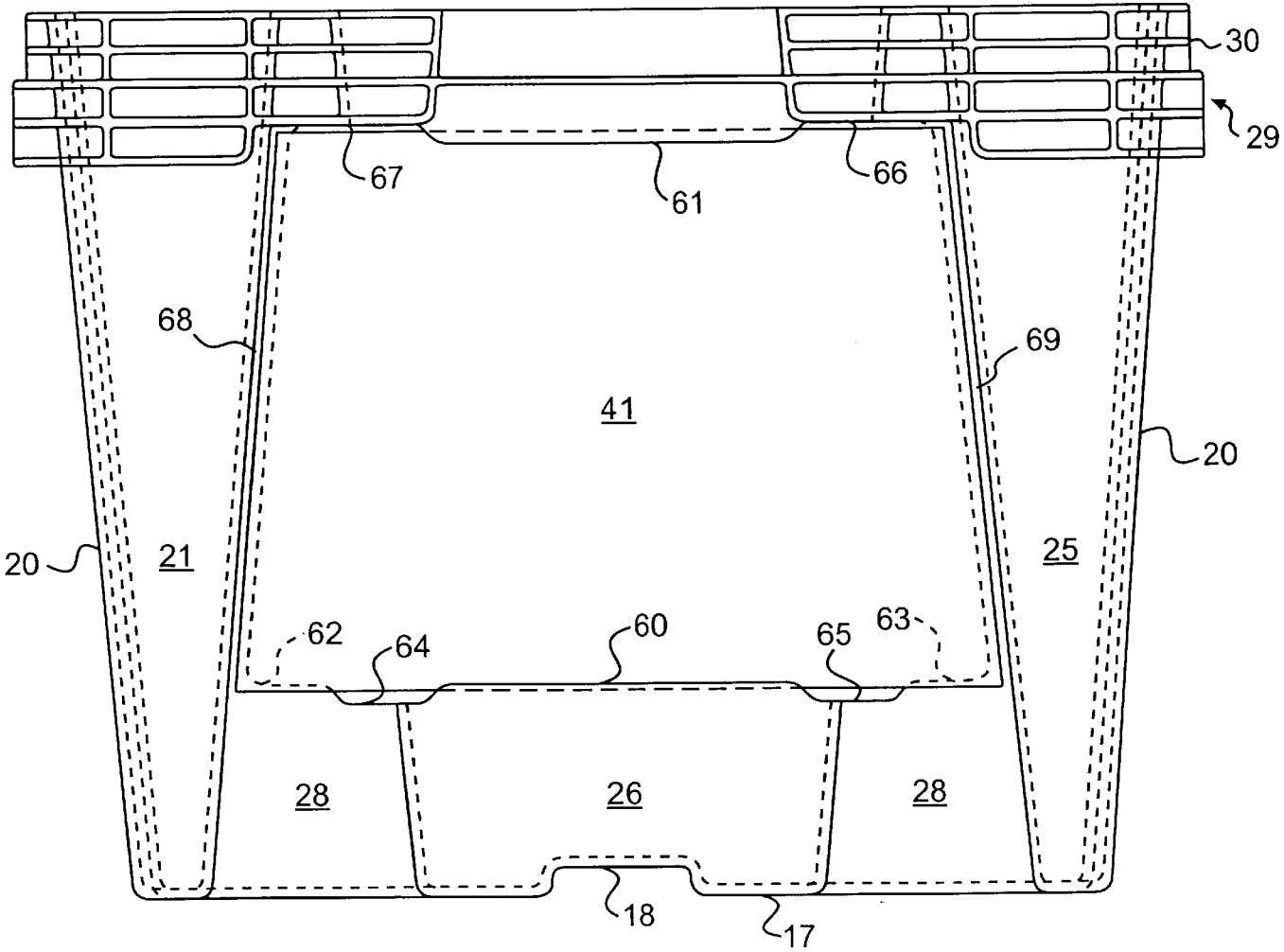
FIG. 7 is an end view of the container shown in FIG. 1 with a closure panel fit in the opening in the end wall of the container.

According to the invention, the access openings 15, 16 are closed by replaceable or expendable closure panels 40, 41 respectively, as shown in FIGS. 5 and 7. Preferably, the replaceable or expendable closure panels 40, 41 have an area that is suitable for display of a commercial message or other indicia related to the contents of the container, or advertising, desired to be visible during shipping or storage of the containers. Since the containers are of a design that is readily adaptable to many uses, it is contemplated that the contents of the container may be of varying kinds. Accordingly, it is useful to have such a display area on which a description of the contents of the container or advertising can be displayed.

Figure 8:
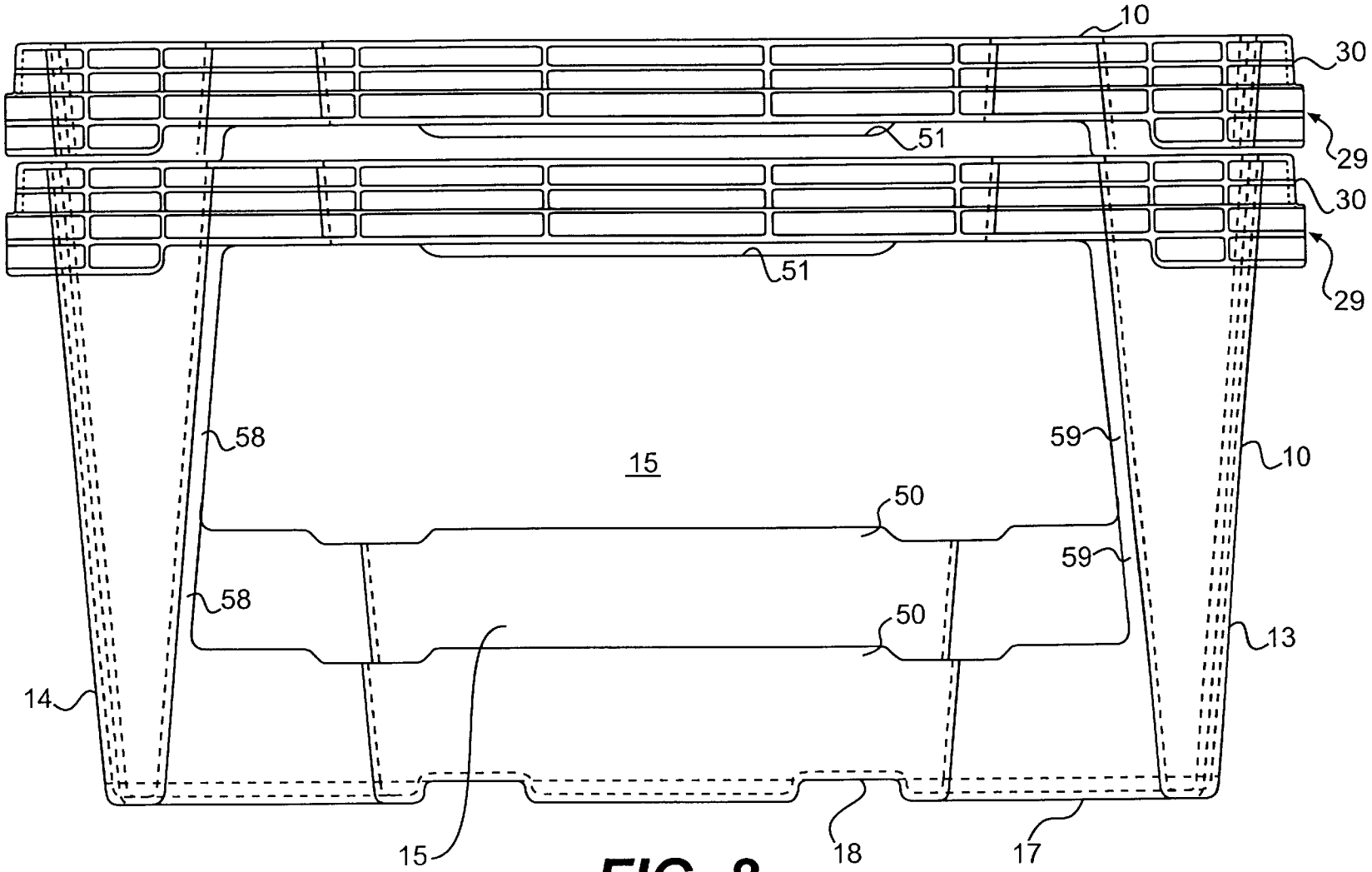
FIG. 8 is a view of two open top containers constructed according to the invention shown stacked in a nested relationship without closure panels.

For example, upon closure of access openings 15 and 16 with side and end panels 40, 41 the container can be filled with contents for shipping. After shipping, the contents of the container can be accessed through the open top or optionally, after removal of one or both of the side and end panels 40, 41 through access openings 15, 16. Finally, after emptying the container, like containers can be stacked in a nested relation as shown in FIG. 8 without lids 35. Then, lids 35 can be stacked separately and both containers 10 and lids 35 returned to their origin.

Upon the next use of a container 10, a user may find that the panels 40, 41 have remained intact and then the container can be reused with the panels in place. Alternatively, new panels 40, 41 can be inserted in the access openings 15, 16 with the same indicia displayed or a different one, at the user's discretion. Since the panels 40, 41 are designed to be expendable, if the container is returned without the panels, as shown in FIG. 8, the manufacturer can readily insert new panels in the access openings and easily reuse the container.

Figure 3:
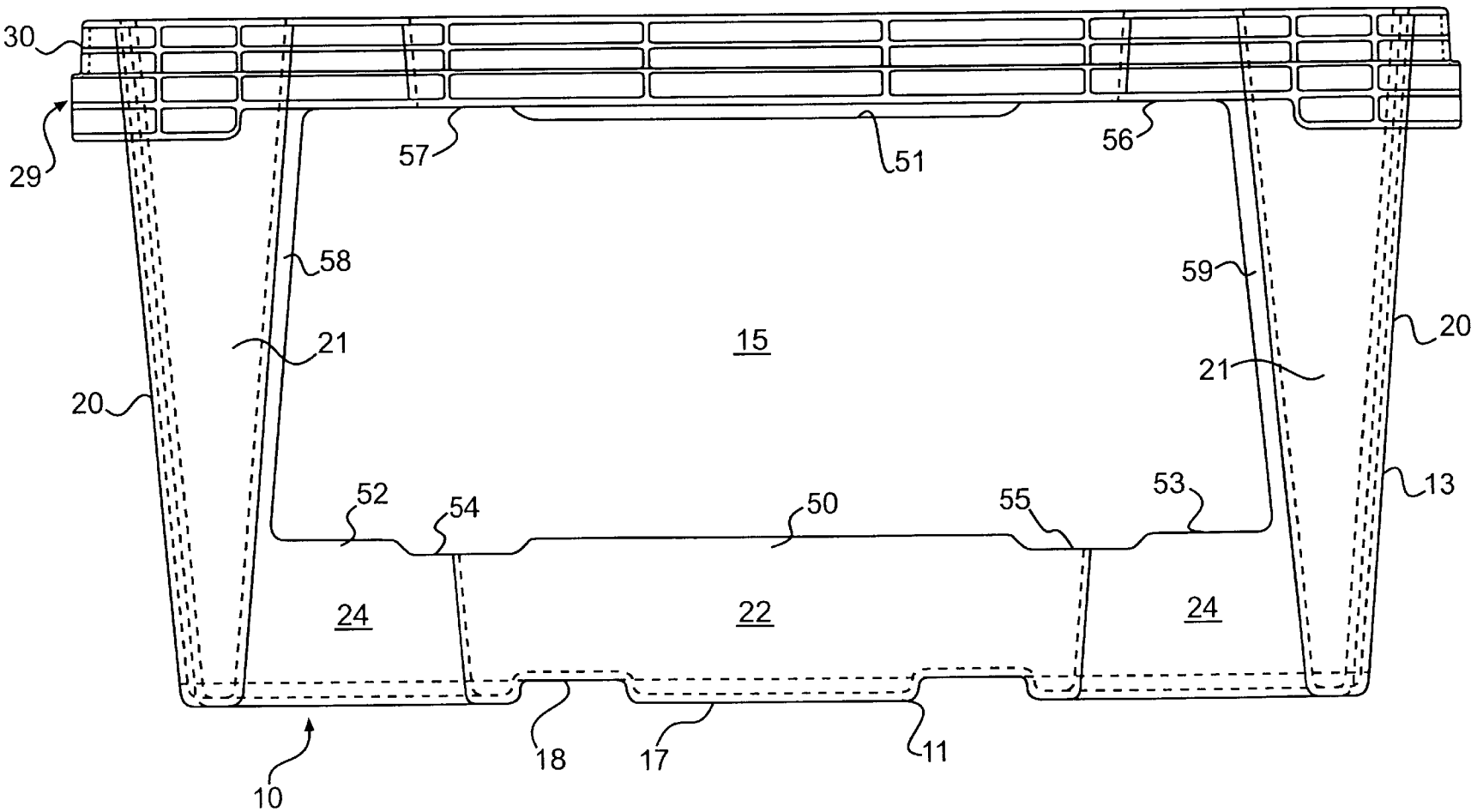
FIG. 3 is a side view of the container shown in FIG. 1 without the lid.
Figure 4:
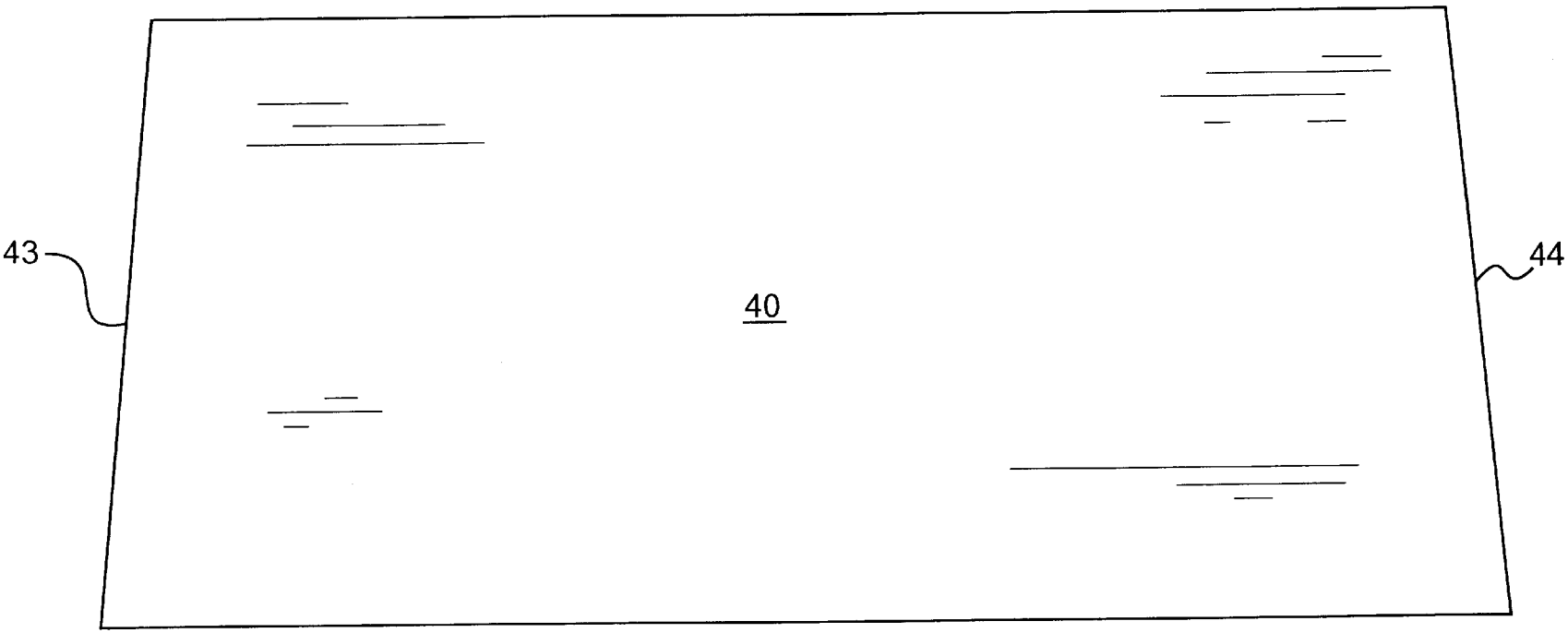
FIG. 4 is a plan view of a replaceable closure panel according to the present invention.

Referring to FIG. 3, a side view of container 10 is shown, which has access opening 15. A panel 40, shown in plan view in FIG. 4, is intended to be fit into the access opening 15. Panel 40 (and also panel 41) is preferably made of a thin substrate of a lightweight inexpensive material, such as cardboard, fiberboard or even plastic. The panels can be manufactured at a low cost since they are essentially flat, and also since they are essentially flat, indicia can be easily printed on the face of the panels. The panels have a bisymmetrical shape, and therefore may be reversed, thereby permitting a manufacturer to store a stock of panels having different indicia printed on each side wherein the panels are installed with the appropriate side facing outwardly depending on the intended use for the container.

To hold a panel 40 (or 41) in place in the access opening, the edges of the panel are held between structures formed about the periphery of the access opening. In particular, as shown in FIG. 5, there are lower and upper tabs 50 and 51 which the panel fits behind, with the remainder of the structure formed around the periphery of the access opening supporting the panel from behind. This includes bottom flanges 52 and 53 and side flanges 58 and 59.

Between the tab 50 and the bottom flanges 52 and 53 are spaces 54 and 55, in the lower part of the access opening that are vertically aligned with spaces 56 and 57 formed in the upper part of the access opening. With reference to FIG. 5, a panel 40 is inserted in an access opening by guiding one of the sides 43 or 44 of the panel into one of the respective pairs of upper and lower spaces 55, 56 or 54, 57, followed by positioning the panel to fit in place behind tabs 50 and 51, and then further guiding the leading side 43, 44 into the other one of the pairs of spaces 55, 56 or 54, 57 to fit the edge of the leading side of the panel into place in front of one of the side flanges 58, 59 and corresponding flanges 52, 53 thereby leaving the edge of the other end of the panel supported by the other of the side flanges 58, 59 and corresponding flanges 52, 53.

Figure 6:
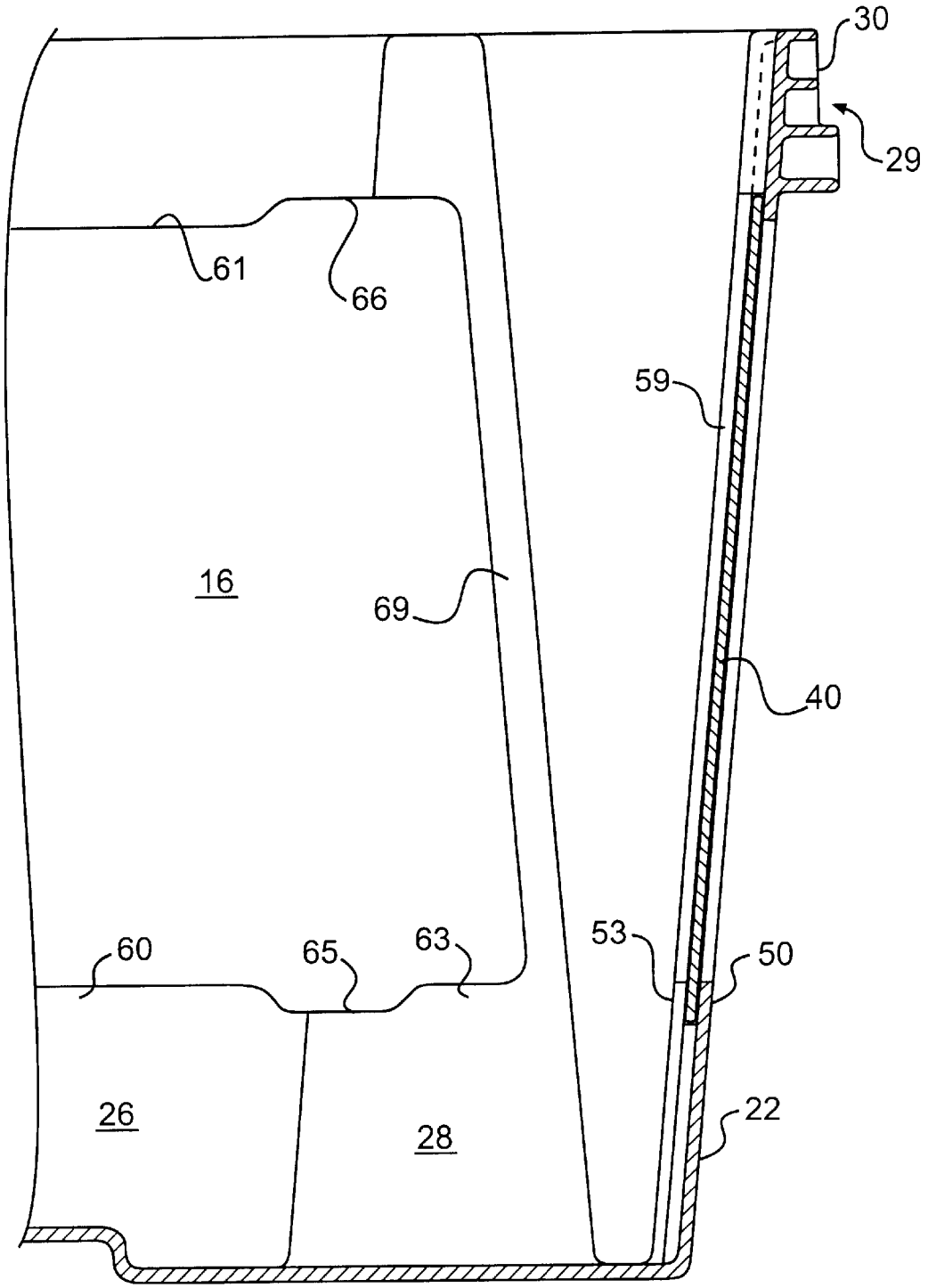
FIG. 6 is a cross-sectional view of the side wall of the container taken along line 6—6 shown in FIG. 5.

As shown in FIG. 6, since tabs 50 and 51 are in the same plane, the front face of the panel 40 is secured in a relatively flat position, preferably coplanar with the side wall of the container. Preferably, the panel 40 is about the thickness of the separation distance between the plane in which bottom flanges 52 and 53 and side flanges 58 and 59 extend, i.e. the distance between the plane of recessed side wall portion 24 and the plane of the center portion 22 of the side wall. In this way, the panel is disposed in a relatively flat manner without the need for it to be further secured in position. This makes the access panel easily fit into place and also easily removable.

Although the foregoing description has been with reference to the inserting of panel 40 in access opening 15, the same description applies to inserting panel 41 in access opening 16 so that it takes the position shown in FIG. 7. That is, the panel 41 is held in place behind tabs 60 and 61, while being supported about its edges by lower flanges 62, 63, and side flanges 68 and 69. Further, spaces 64 and 65 are provided between flange 62 and tab 60 on the one side and between flange 63 and tab 60 on the other side at the lower part of the access opening that permit insertion of the panel 41 in combination with vertically aligned spaces 66 and 67, as explained with reference to FIGS. 5 and 6.

FIG. 8 shows two containers 10 constructed according to the invention. The containers are stacked in a nested stack. Nesting is permitted by the inwardly tapered walls 11–14 of the container and the engagement and support of the peripheral flange structure 29 of an upper container on the flange structure 29 on the lower container. Engagement of the flange structures in the manner shown in FIG. 8 provides a nesting stop to prevent jamming of the containers when stacked in a nested relation as shown in the figure.

Also as shown in FIG. 8, the nested stack is formed with the panels 40 and 41 (not shown) removed, but the panels may be left intact during return shipment of the containers. When the panels 40, 41 are intact during return shipment of the containers in a nested stack, the panels do not interfere with the nested stacking of the containers.

I claim:

1. A container with a lid, comprising:

opposed side walls and opposed end walls joined by a bottom wall and having an open top, said container having a plastic molded unitary construction;

said container being stackable and nestable with like containers; and at least one of said side and end walls having an access opening surrounded by said at least one of said side and end walls and a substantially flat removable panel having opposite faces for covering said access opening, wherein said access opening has structure about a periphery of said opening for holding both faces of said panel at edge portions thereof when said panel is in a position covering said access opening, wherein said container is reusable and said panel is expendable after being removed from covering said access opening to gain access to contents in said container and wherein the structure about the periphery of said access opening includes upper and lower single tabs disposed in a first plane and single side flanges on opposite sides of said access opening in a second plane, wherein said first plane is laterally offset with respect to said second plane by a distance substantially equal to a thickness of the panel, and wherein a front one of said panel faces is engaged behind said upper and lower tabs and a rear one of said panel faces is engaged in front of said side rails when said panel is in said position covering said access opening.

2. A container according to claim 1, wherein said removable panel is formed of cardboard and has a thickness approximately the same as a thickness of said wall in which said access opening is formed.

3. A container according to claim 2, wherein said removable panel has an area on at least one of said faces in which indicia is displayed.

4. A container according to claim 3, wherein said removable panel is substantially trapezoidal in shape.

5. A container with a lid, comprising:

opposed side walls and opposed end walls joined by a bottom wall and having an open top, said container having a plastic molded unitary construction;

said container being stackable and nestable with like containers; and a first access opening formed in one said side wall and a second access opening formed in one said end wall, each said access opening being surrounded by said one side wall and said one end wall, respectively; and first and second substantially flat removable panels for respectively covering said first and second access openings, wherein each said access opening has a periphery with single tabs and single side flanges for holding both faces of said panel at edge portion thereof when said panel is in a position covering said respective access opening, and wherein said container is reusable and each said panel is expendable after being removed from covering said access openings to gain access to contents in said container.

6. A container according to claim 5, wherein each of said panels is formed of cardboard and has a thickness approximately the same as a thickness of the respective ones of said side and end walls in which said first and second access openings are formed.

7. A container according to claim 6, wherein said panels each have an area on at least one of said faces in which indicia is displayed.

8. A container according to claim 5, wherein said single tabs and side flanges formed about the periphery of each of said first and second access openings include upper and lower tabs disposed in a first plane and said side flanges being formed on opposite sides of said access opening that are formed in a second plane, wherein said first plane is laterally offset with respect to said second plane by a distance substantially equal to a thickness of the respective one of said first and second panels, and wherein for each said panel a front one of said panel faces is engaged behind said upper and lower tabs and a rear one of said panel faces is engaged in front of said side rails when each said panel is in said position covering a respective one of said first and second access openings.

9. A container according to claim 8, further including upper spaces adjacent said upper tab and lower spaces adjacent said lower tab, and adjacent flanges formed between said lower spaces and said side flanges, respectively, wherein said spaces are substantially vertically aligned and permit insertion of a leading edge of said removable panel when positioning said removable panel in the position covering each of said first and second access openings, and wherein said rear panel face is engaged in front of said adjacent flanges when said panel is in said position covering each said access opening.

10. A container according to claim 1, further including said bottom wall having a stacking grid and said lid having a stacking grid matching said bottom wall stacking grid for assisting in stacking of like ones of said containers.

11. A container according to claim 10, wherein said lid is a separate removable lid.

12. A container according to claim 5, further including said bottom wall having a stacking grid and said lid having a stacking grid matching said bottom wall stacking grid for assisting in stacking of like ones of said containers.

13. A container according to claim 1, further including a top peripheral flange structure having upper and lower surfaces, wherein said upper surface of said peripheral flange structure of one said container engages said lower surface of said peripheral flange structure of another said container when nested within said one container.

14. A container according to claim 13, wherein said lid is a separate removable lid.

15. A container according to claim 5, further including a top peripheral flange structure having upper and lower surfaces, wherein said upper surface of said peripheral flange structure of one said container engages said lower surface of said peripheral flange structure of another said container when nested within said one container.

* * * * *